US011333299B2

(12) United States Patent
Otsubo

(10) Patent No.: US 11,333,299 B2
(45) Date of Patent: May 17, 2022

(54) HIGH PRESSURE TANK

(71) Applicant: TOYOTA JIDOSHA KABUSHIKI KAISHA, Toyota (JP)

(72) Inventor: Hirokazu Otsubo, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/296,491

(22) Filed: Mar. 8, 2019

(65) Prior Publication Data

US 2019/0309903 A1 Oct. 10, 2019

(30) Foreign Application Priority Data

Apr. 6, 2018 (JP) ..... JP2018-074132

(51) Int. Cl.
*F17C 1/02* (2006.01)

(52) U.S. Cl.
CPC ..... *F17C 1/02* (2013.01); *F17C 2201/0109* (2013.01); *F17C 2203/012* (2013.01); *F17C 2203/0604* (2013.01); *F17C 2203/066* (2013.01); *F17C 2203/0619* (2013.01); *F17C 2203/0663* (2013.01); *F17C 2205/0305* (2013.01); *F17C 2221/012* (2013.01); *F17C 2270/0184* (2013.01)

(58) Field of Classification Search
CPC ..... F17C 2205/0305; F17C 1/02; F17C 2203/0604; F17C 2203/066; F17C 2203/012; F17C 2203/0619; F17C 2221/012; F17C 2270/0184; F17C 2201/0109; F17C 2203/0663
See application file for complete search history.

(56) References Cited

U.S. PATENT DOCUMENTS

2009/0200318 A1* 8/2009 Handa ..... F17C 7/00 220/586
2015/0014332 A1* 1/2015 Nishibu ..... F17C 1/16 220/586
2016/0123538 A1* 5/2016 Nakamura ..... F17C 13/06 220/582

(Continued)

FOREIGN PATENT DOCUMENTS

DE 10 2014 109 373 A1 1/2015
JP 09-242990 A 9/1997
JP 10-141594 A 5/1998

(Continued)

OTHER PUBLICATIONS

Office Action dated Sep. 17, 2021 in Chinese Application No. 201910265513.8.

(Continued)

*Primary Examiner* — Don M Anderson
(74) *Attorney, Agent, or Firm* — Sughrue Mion, PLLC

(57) ABSTRACT

A high pressure tank includes two ferrules, a resin liner that covers outer parts of the ferrules at both end parts of the resin liner to fixedly install the ferrules, and a CFRP reinforcing layer formed on an outer surface side of the resin liner and attached to the resin liner at a center of a body part of the resin liner. Two leading end parts of the resin liner covering the outer parts of the ferrules protrude from end openings provided at both end parts of the CFRP reinforcing layer.

3 Claims, 3 Drawing Sheets

(56) References Cited

U.S. PATENT DOCUMENTS

| | | | | |
|---|---|---|---|---|
| 2017/0038006 | A1 | 2/2017 | Emori | |
| 2017/0284601 | A1* | 10/2017 | Kusaba | F17C 1/04 |

FOREIGN PATENT DOCUMENTS

| | | | |
|---|---|---|---|
| JP | 2002-5397 | A | 1/2002 |
| JP | 2014-238110 | A | 12/2014 |
| JP | 2015-017641 | A | 1/2015 |
| JP | 2015-031307 | A | 2/2015 |
| JP | 2017-145959 | A | 8/2017 |

OTHER PUBLICATIONS

Su Peng-Fei, "Chemical standard terminology", 1988, p. 166 (3 pages total).

* cited by examiner

HIGH PRESSURE TANK

CROSS REFERENCE TO RELATED APPLICATIONS

This application is based upon and claims the benefit of priority from Japanese patent application No. 2018-74132, filed on Apr. 6, 2018, the disclosure of which is incorporated herein in its entirety by reference.

BACKGROUND

The present disclosure relates to a high pressure tank.

Various developments have been made regarding a structure of a high pressure tank (e.g., Japanese Unexamined Patent Application Publication No. 2015-17641). Japanese Unexamined Patent Application Publication No. 2015-17641 describes a technique of interposing a releasing agent layer between a liner and a fiber reinforced plastic layer.

SUMMARY

When a liner is formed of a resin, a shrinkage rate with respect to a temperature change of the liner differs from that of a reinforcing layer surrounding an outer periphery of the liner. Thus, stress at the time of shrinkage concentrates particularly on a ferrule part. In the structure of the related art, if stress concentrates on the ferrule part, the liner may separate from the ferrule and shrink.

The present disclosure provides a high pressure tank that effectively prevents concentration of stress on the ferrule even when the liner shrinks and that does not cause the liner to separate from the ferrule.

A specific example aspect of the present disclosure is a high pressure tank including: two ferrules; a resin liner that covers outer parts of the ferrules at both end parts of the resin liner to fixedly install the ferrules; and a CFRP reinforcing layer formed on an outer surface side of the resin liner and attached to the resin liner at a center of a body part of the resin liner. Two leading end parts of the resin liner covering the outer parts of the ferrules protrude from end openings provided at both end parts of the CFRP reinforcing layer.

With this structure in which the CFRP reinforcing layer and the resin liner are adhered to each other at the center of the body part, and the resin liner covers the outer side of the ferrule and protrudes together with the ferrule from the end opening of the CFRP reinforcing layer, when the resin liner shrinks, the protruding part slides backward together with the ferrule from the end opening toward the inside, no stress concentrates near the ferrule, and the resin liner does not separate from the ferrule.

In the above high pressure tank, the ferrule may be configured to include a cylindrical part penetrating the end opening of the CFRP reinforcing layer and a bottom part connected to the cylindrical part on a side of the body part of the resin liner and including a diameter larger than a diameter of the cylindrical part, and the bottom part may be configured to include serration parts at its outer periphery. Such serration parts increase an area in which the resin liner is brought into contact with the ferrule parts, thereby making the resin liner and the ferrule be firmly integrated with each other. This effectively prevents the ferrules from separating from the resin liner when the resin liner shrinks. When the CFRP reinforcing layer is formed on the outer surface side of the resin liner by the filament winding (FW) method, the speed of the winding process can increased.

According to the present disclosure, it is possible to provide a high pressure tank that effectively prevents concentration of stress on the ferrule even when the liner shrinks and that does not cause the liner to separate from the ferrule.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Figure 1:
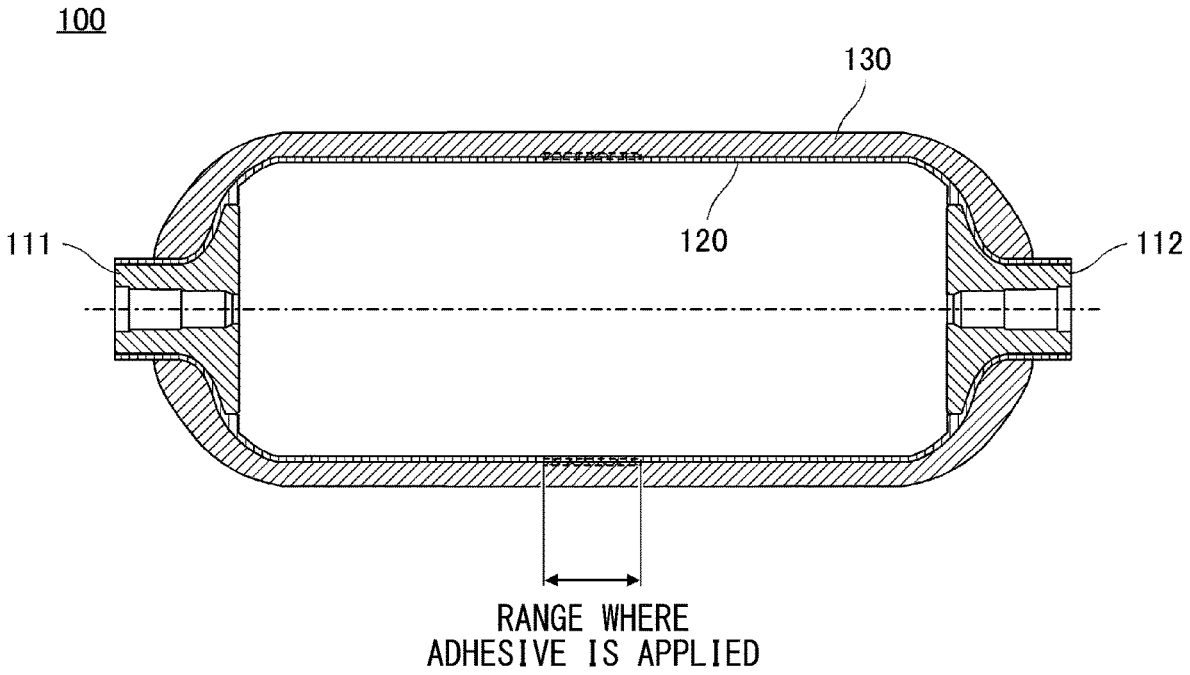
FIG. 1 is a central cross-sectional view of a high pressure tank according to this embodiment.

FIG. 1 is a central cross-sectional view of a high pressure tank 100 according to this embodiment. The high pressure tank 100 is used to store, for example, hydrogen as fuel gas used in a vehicle-mounted fuel cell system.

The high pressure tank 100 includes two ferrules 111 and 112, a resin liner 120 for fixedly installing the ferrules 111 and 112 at both ends of the resin liner 120, respectively, and a CFRP reinforcing layer 130 formed on an outer surface side of the resin liner 120.

The ferrules 111 and 112 are members that attach nozzles for filling gas into a container and for taking out gas from the inside of the container, and are made of a metal material. The resin liner 120 is a tank molded by blow molding using a resin having gas barrier properties against hydrogen gas such as a nylon resin. The resin liner 120 is composed of a cylindrical body part positioned at a center and a dome part having a curved shape positioned at each of both end parts. As shown in the drawing, the ferrule 111 is fixedly installed at a vertex of the leftmost dorm part, and the ferrule 112 is fixedly installed at a vertex of the rightmost dome part. A specific structure will be described later.

The CFRP reinforcing layer 130 is a reinforcing layer using Carbon Fiber Reinforced Plastic. The CFRP reinforcing layer 130 is formed by a Filament Winding (FW) method in which carbon fiber impregnated with a thermosetting resin in advance is winded around the outer surface of the resin liner 120. Thus, an entire shape of the CFRP reinforcing layer 30 is approximately along an outer shape of the resin liner 120. That is, the CFRP reinforcing layer 30 has a shape composed of a cylindrical body part positioned at a center and a dome part having a curved shape positioned at each of both end parts.

The resin liner 120 and the CFRP reinforcing layer 130 are attached to each other at the center of the body parts of them. Specifically, an adhesive is applied to a certain range (e.g., to the shaded area shown in the drawing) of the outer surface of the center of the body part of the resin liner 120 when the carbon fiber is winded around the outer surface of the resin liner 120 by the FW method to adhere the winding carbon fiber, so that the resin liner 120 and the CFRP reinforcing layer 130 are attached to each other. The resin liner 120 and the CFRP reinforcing layer 130 do not have a part attached to each other except for the attached range at the center of the body parts.

Figure 2:
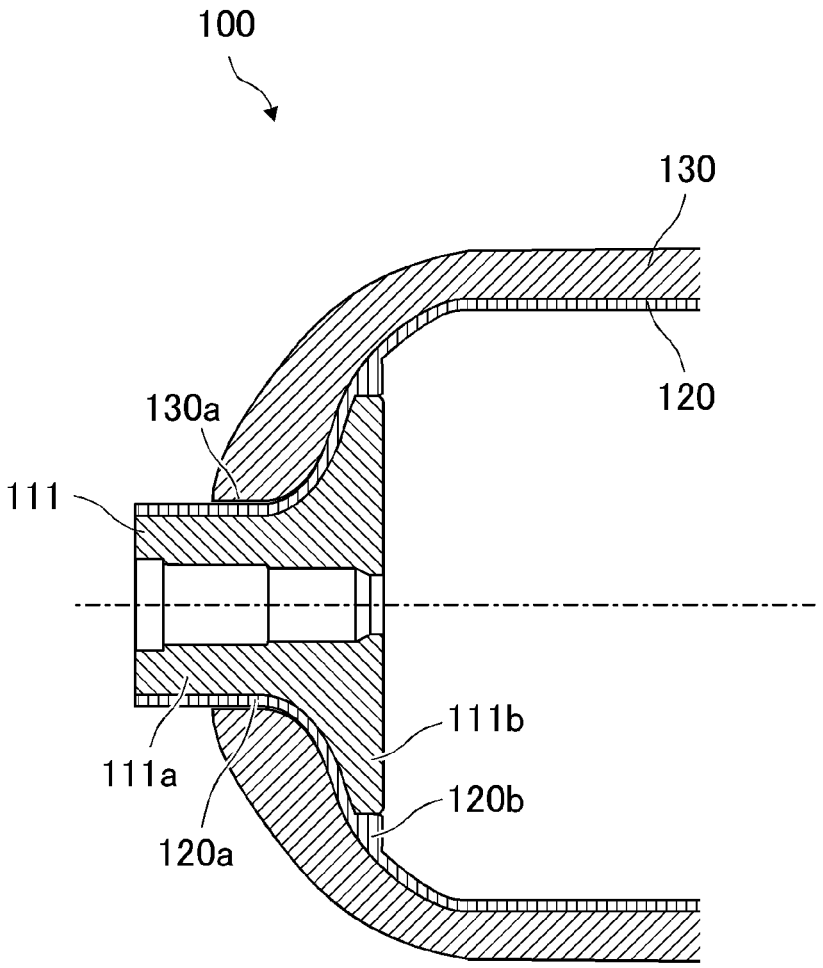
FIG. 2 is a cross-sectional view showing a state of a leading end part of the high pressure tank at normal temperature.

FIG. 2 is a cross-sectional view showing a state of the leading end part (a left end side) of the high pressure tank 100 at room temperature. The state of the left end side is the same as that of the right end side on which the ferrule 112 is fixedly installed, and thus the left end side will be described in detail as an example.

At normal temperature, the outer surface of the resin liner 120 is substantially in close contact with an inner peripheral surface of the CFRP reinforcing layer 130. In particular, in a state in which high pressure gas is filled inside, the CFRP reinforcing layer 130 having a high pressure resistance holds down the resin liner 120 which is expanding to keep the outer shape of the high pressure tank 100 constant.

The ferrule 111 has a cylindrical part 111*a* and a bottom part 111*b* that is continuous with the cylindrical part 111*a*. The bottom part 111*b* has an approximately circular shape and its diameter is larger than a diameter of the cylindrical part.

The ferrule 111 is installed in a mold in blow molding, and a melted resin enters a gap between the metal mold and the ferrule to surround the ferrule 11, so that the ferrule 111 is integrated with the resin liner 120 at the same time as the molding of the resin liner 120. In this embodiment, as shown in the drawing, the resin comes around the ferrule 11 so as to cover an outer part thereof from the cylindrical part 111*a* to the bottom part 111*b* of the ferrule 111, so that an outer covering part 120*a* holding the ferrule 111 inside is formed at the vertex of the doom part of the resin liner 120. Thus, the outer part of the ferrule 111 does not appear from the surface above the resin liner 120 and is not brought into direct contact with the CFRP reinforcing layer 130. As will be described in detail later, a serration filling part 120*b* filled with many resins is formed in the bottom part 111*b* of the ferrule 111, whereby the ferrule 111 and the resin liner 120 are more firmly integrated with each other.

The CFRP reinforcing layer 130 includes an end opening 130*a* for protruding the cylindrical part 111*a* of the ferrule 111 to the outside. That is, the CFRP reinforcing layer 130 has a three-dimensional shape in which an inner space communicates with an outer space via the end opening 130*a* provided at the vertex part of the dome part. A leading end part of the resin liner 120 covering the outer part of the ferrule 111, i.e., a part of a leading end of the outer covering part 120*a* which covers the cylindrical part 111*a*, protrudes from the end opening 130*a* of the CFRP reinforcing layer 130. At this time, the diameter of the end opening 130*a* is slightly larger than the diameter of the part of the outer covering part 120*a* which covers the cylindrical part 111*a*.

Figure 3:
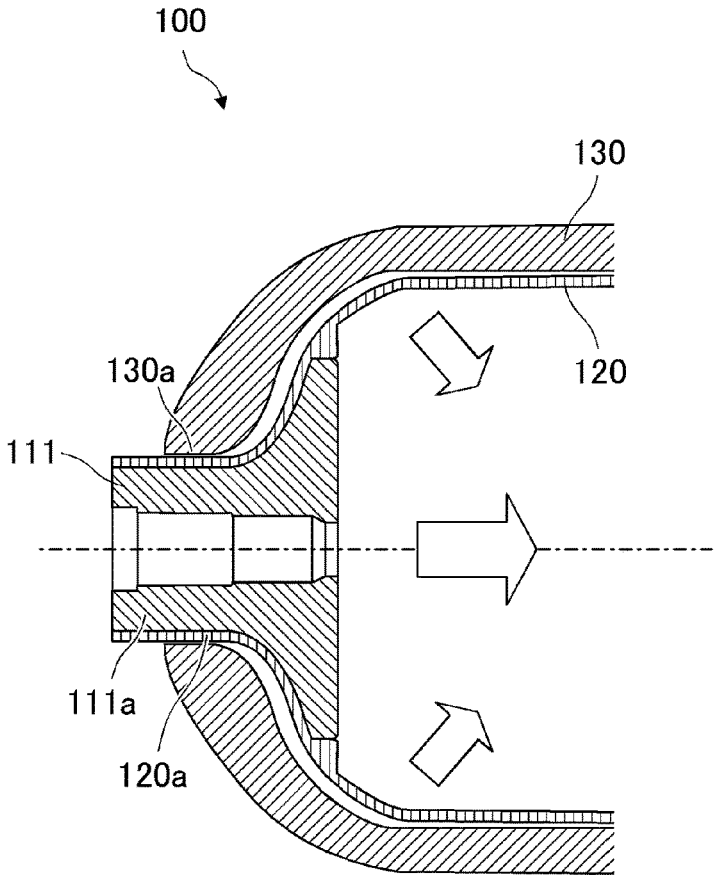
FIG. 3 is a cross-sectional view showing a state of the leading end part of the high pressure tank at low temperature.

FIG. 3 is a cross-sectional view showing a state of the leading end part (the left end side) of the high pressure tank 100 at low temperature. The state of the left end side is the same as that of the right end side on which the ferrule 112 is fixedly installed, and thus the left end side will be described in detail as an example.

For example, when the high pressure tank 100 is used for filling hydrogen gas to be used for a fuel cell vehicle, a large amount of hydrogen is continuously discharged while the vehicle travels at a high speed. At this time, the high pressure tank 100 rapidly becomes a low temperature state due to the adiabatic expansion of the hydrogen inside. Commonly, the resin forming the resin liner 120 greatly shrinks with a decrease in the temperature as compared with carbon fiber reinforced plastic. That is, the shrinkage rate per unit temperature of the resin is larger that of the carbon fiber reinforced plastic.

In a situation in which the temperature rapidly drops, when the resin liner and the CFRP reinforcing layer are adhered to each other over the entire surface, a force trying to separate this liner from layer from each other against an adhesive force acts, and stress concentrates near the ferrule in particular. The liner of the related art may separate from the ferrule and shrink, because it has a structure in which the ferrule is brought into close contact with the bottom surface of the liner to be fixed thereto.

As described above, the resin liner 120 and the CFRP reinforcing layer 130 of the high pressure tank 100 according to this embodiment are attached to each other at the center of the body parts, and are not attached to other parts. Further, the resin liner 120 is fixedly installed in such a way that the outer covering part 120*a* holds the ferrule 111 inside it. Further, the diameter of the end opening 130*a* is slightly larger than the diameter of the part of the outer covering part 120*a* which covers the cylindrical part 111*a*.

With such a structure, when the resin liner 120 shrinks, the protruding part of the outer covering part 120*a* slides backward together with the ferrule 111 from the end opening 130*a* toward the inside of the CFRP reinforcing layer 130. Thus, no stress concentrates near the ferrule 111, and the resin liner 120 does not separate from the ferrule 111. Further, no stress concentrates on the dorm part, because the dome part of the resin liner 120 can also be separated from the dome part of the CFRP reinforcing layer 130.

Moreover, since the resin liner 120 as the outer covering part 120*a* covers the outer part of the ferrule 111, even when the outer covering part 120*a* tries to shrink, the ferrule 111 effectively prevents its shrinkage from the inside. That is, the amount of separation in which the resin liner 120 separates from the CFRP reinforcing layer 130 will not become so large. That is, even when the high pressure tank 100 is exposed to a low temperature state, the functions of the high pressure tank 100 can be maintained without any damage.

Figure 4:
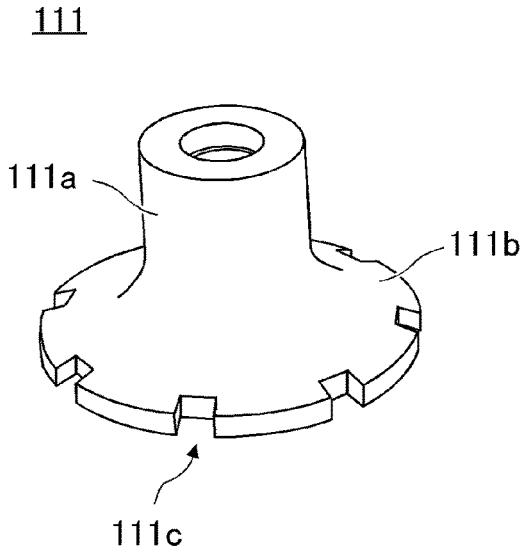
FIG. 4 is a perspective view of a ferrule.

In other words, the high pressure tank 100 can be used safely even at low temperature and under low pressure, and thus it is possible to lower, for example, a gas deficiency pressure of a fuel cell vehicle that implements the high pressure tank 100 and to extend a traveling distance. In addition, FIPG interposed between the resin liner and the reinforcing layer in the related art can be eliminated, which contributes to cost reduction. FIG. 4 is a perspective view of the ferrule 111. The descriptions of the ferrule 112 are omitted, because the structure thereof is the same as that of the ferrule 111.

As described above, the ferrule 111 has the cylindrical part 111*a* penetrating the end opening 130*a* of the CFRP reinforcing layer 130 and the bottom part 111*b* connected to the cylindrical part 111*a* on the side of the body part of the resin liner 120 and having a diameter larger than the diameter of the cylindrical part 111*a*. As shown in the drawing, the bottom part 111*b* has serration parts 111*c* at regular intervals at its outer periphery. The serration parts 111*c* are serrated grooves. When the serrated grooves are filled with the resin of the resin liner 120 to form the above serration filling parts 120*b*, a thick part of the resin is formed on an outer peripheral part of the bottom part 111*b*, and the contact area is increased, thereby making the resin liner 120 and the ferrule 111 be firmly integrated with each other.

Therefore, the ferrule 111 will not be detached or incline when the resin liner 120 shrinks. In addition, improvement of rigidity near the outer covering part 120*a* surrounding the ferrule 111 can contribute to increasing the speed of winding the carbon fiber in the FW method.

Although this embodiment has been described above, the high pressure tank 100 can also be applied to applications other than the filling of hydrogen. For example, the high pressure tank 100 may be used as a tank to be filled with oxygen or liquid nitrogen. Furthermore, each of the above-shown shapes is an example, and can be achieved in various shapes without departing from the sprit thereof.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A high pressure tank comprising: two ferrules; a resin liner that covers outer parts of the ferrules at a first end part and a second end part of the resin liner to fixedly install the ferrules, the resin liner comprising an elongated cylindrical region connecting the two ferrules; an adhesive applied onto an outer surface side of the resin liner located at a predetermined range of a center of the elongated cylindrical region; and a CFRP reinforcing layer formed on the outer surface side of the resin liner, wherein the CFRP reinforcing layer is attached to the resin liner with the adhesive such that the resin liner and the CFRP reinforcing layer do not have a part attached to each other except for the attached range at the center of the elongated cylindrical region of the resin liner, and the adhesive is not disposed on the CFRP reinforcing layer and the resin liner, except for the predetermined range of the center of the elongated cylindrical region, wherein a leading end part of the resin liner covering the outer parts of the ferrules protrudes from end openings provided at a first end part and a second end part of the CFRP reinforcing layer.

2. The high pressure tank according to claim 1, wherein the ferrule includes a cylindrical part penetrating the end opening of the CFRP reinforcing layer and a bottom part connected to the cylindrical part on a side of the elongated cylindrical region of the resin liner and including a diameter larger than a diameter of the cylindrical part, and the bottom part includes serration parts at its outer periphery.

3. The high pressure tank according to claim 2, wherein a diameter of the end opening of the CFRP reinforcing layer is larger than a diameter of a part of the resin liner.

* * * * *